US008380120B1

(12) United States Patent
Ruhlman et al.

(10) Patent No.: US 8,380,120 B1
(45) Date of Patent: Feb. 19, 2013

(54) DEVICE FOR ACCEPTING AND STORING MESSAGES

(75) Inventors: Meagan Ruhlman, Bratenahl, OH (US); Derek K. Gauger, Vancouver (CA); George P. Dudash, Willowick, OH (US); Jay D. Duffy, Kent, OH (US); Adam Deel, North Olmsted, OH (US)

(73) Assignee: Preformed Line Products Company, Mayfield Village, OH (US)

( * ) Notice: Subject to any disclaimer, the term of this patent is extended or adjusted under 35 U.S.C. 154(b) by 181 days.

(21) Appl. No.: 12/706,280

(22) Filed: Feb. 16, 2010

Related U.S. Application Data

(60) Provisional application No. 61/152,926, filed on Feb. 16, 2009.

(51) Int. Cl.
*G09B 5/00* (2006.01)
*A63H 33/04* (2006.01)

(52) U.S. Cl. ..... 434/308; 446/75

(58) Field of Classification Search ..... None
See application file for complete search history.

(56) References Cited

U.S. PATENT DOCUMENTS

| | | | | |
|---|---|---|---|---|
| 4,583,661 | A * | 4/1986 | Clover, Jr. | 222/42 |
| 5,324,201 | A * | 6/1994 | Friedel | 434/236 |
| 6,027,392 | A * | 2/2000 | Ruhlman | 446/75 |
| 6,779,814 | B2 * | 8/2004 | Polick | 281/15.1 |

FOREIGN PATENT DOCUMENTS

FR 2591501 * 12/1985

OTHER PUBLICATIONS

Mattel, Inc.—Girl Tech International, Password Journal, 2008, http://www.girltch.com/electronics-passwordJournal.aspx.

* cited by examiner

*Primary Examiner* — Julie Brocketti
(74) *Attorney, Agent, or Firm* — Kegler Brown Hill & Ritter; James J. Pingor

(57) ABSTRACT

A message storage apparatus that can stimulate creativity and imagination of children and adolescents is disclosed. The apparatus facilitates storage of messages such as secrets, memories, notes, diary entries, wishes, dreams, trivia and other educational facts, quiz and other game questions, valentines, etc. More particularly, the apparatus can virtually (or physically) store intangible (and tangible) messages, thereby enhancing creativity and imagination. The message storage apparatus has a message delivery system that receives a message and delivers it securely to a storage chamber where the message can be accessed at a later time.

14 Claims, 17 Drawing Sheets

DEVICE FOR ACCEPTING AND STORING MESSAGES

CROSS-REFERENCE TO RELATED APPLICATIONS

This application claims the benefit of U.S. Provisional Patent application Ser. No. 61/152,926 entitled "APPARATUS FOR STORING MESSAGES SECRETS AND THE LIKE" and filed Feb. 16, 2009. The entirety of the above-noted application is incorporated by reference herein.

BACKGROUND

Educational games and toys have become prolific in today's marketplace; this is partly because parents and educators recognize the need for supplemental educational stimulation and learning outside of the classroom. However, few of the products in the marketplace provide both educational learning and fun for the child. Stimulation of a child's imagination is an important part of the childhood development cycle. Although parents, siblings, friends and teachers have a critical role in a child's development, individual imaginary play is as important to the child's development Many believe that a child's mind is most creative around the age of eight years old. The years between birth and this age have a profound impact upon a child's future. Creativity is particularly important for a variety of reasons. First and foremost, creativity can develop and improve a child's imaginative skills. Basic skills are often honed by way of a child's creativity and imagination. Additionally, creativity and imagination enable a child to learn at their own pace in an environment that is both educational and fun.

Today, there are countless resources available for parents to help stimulate their child's creativity. As with many decisions throughout the tender years, parents sometimes struggle to make the right choice in selecting toys and activities for their child. Many toys available today offer both amusement and educational value to a child. This stimulation is invaluable in giving the child a head start in life on an educational level. Many of the toys and amusement products available today help a child to learn basic shapes, colors, numeracy, literacy, and creativity. Through the use of stimulating yet enjoyable products, children learn about everything from shapes and colors to numbers and letters.

Children often stimulate their mind through books, puzzles and imaginary friends. Encouragement of imagination both stimulates and nurtures the child's developing mind, curiosity, and creative skills. Imagination also inspires independence and creativity—there is a need for amusement devices that inspire children to learn and develop during these formative years.

SUMMARY

The following presents a simplified summary of the innovation in order to provide a basic understanding of some aspects of the innovation. This summary is not an extensive overview of the innovation. It is not intended to identify key/critical elements of the innovation or to delineate the scope of the innovation. Its sole purpose is to present some concepts of the innovation in a simplified foam as a prelude to the more detailed description that is presented later.

The innovation disclosed and claimed herein, in one aspect thereof, comprises a device that can stimulate creativity and imagination of children and adolescents. Individuals of all ages can be entertained and/or educated through use of the innovation. More particularly, the innovation discloses devices that facilitate storage of messages such as secrets, memories, notes, diary entries, wishes, dreams, trivia and other educational facts, quiz and other game questions, valentines, etc.

In aspects, the device can employ multiple (e.g., two) chambers to receive and store messages. A first chamber can receive the message whereby a user can prompt storage into a second chamber, e.g., for safekeeping. In one aspect, a chamber selector is employed to transfer a message from one chamber to the other. Additional aspects can employ a single chamber or can be configured to convey the appearance of multiple chambers. Because children and adolescents generally enjoy the activity of storing secrets, memories, dreams, diary entries, etc., the innovation can promote creativity and imagination.

To the accomplishment of the foregoing and related ends, certain illustrative aspects of the innovation are described herein in connection with the following description and the annexed drawings. These aspects are indicative, however, of but a few of the various ways in which the principles of the innovation can be employed and the subject innovation is intended to include all such aspects and their equivalents. Other advantages and novel features of the innovation will become apparent from the following detailed description of the innovation when considered in conjunction with the drawings.

DETAILED DESCRIPTION

Figure 1:
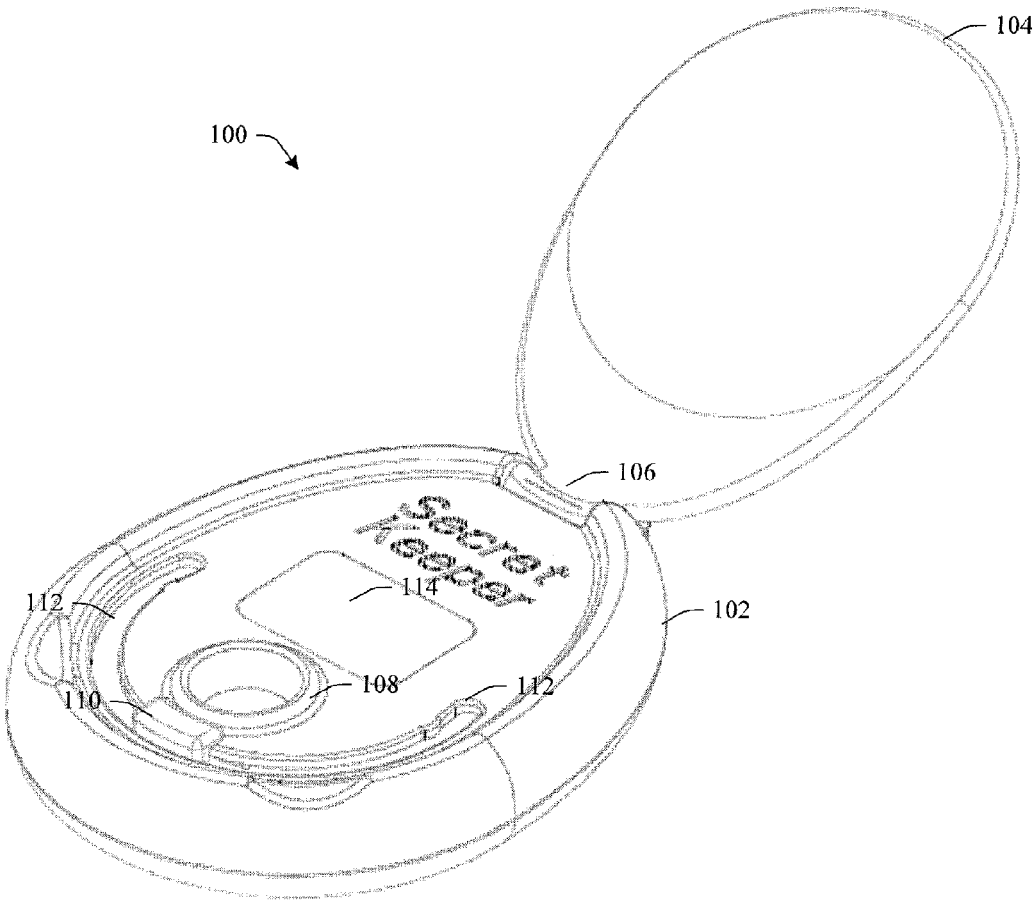
FIG. 1 illustrates a perspective view of an example hinged-open message storage apparatus in accordance with aspects of the innovation.

The following terms are used throughout the description, the definitions of which are provided herein to assist in understanding various aspects of the subject innovation. As used herein, a "message" is intended to refer to most any communication including, but not limited to, a secret, memory, note, diary entry, wish, trivia item or other educational message/fact, dream, quiz or other game entry or question, valentine, message to an imaginary friend, or the like. "Messages" may be real or virtual; in other words, tangible or intangible. For example, a "message" may be a written "message" on a slip of paper, sticker, or other suitable material but also may be spoken words or other forms of virtual (e.g., non-tangible) "messages" (e.g., thoughts or ideas).

The aspects described herein include means to store a "message" or "messages." The devices disclosed and claimed herein are hereinafter referred to as a "message keeper" or "message keepers". These definitions are not intended to limit the scope of the innovation or claims appended hereto. Rather, the definitions are provided to add perspective to the innovation to facilitate a complete and comprehensive understanding of the features, functions and benefits thereof.

The innovation is now described with reference to the drawings, wherein like reference numerals are used to refer to like elements throughout. In the following description, for purposes of explanation, numerous specific details are set forth in order to provide a thorough understanding of the subject innovation. It may be evident, however, that the innovation can be practiced without these specific details.

Referring initially to FIG. 1, a perspective view of a message keeper 100 in accordance with aspects of the innovation is shown. As illustrated, the message keeper 100 can have a base housing portion 102 and a cover portion 104. In this aspect, the cover portion 104 is hingedly connected to the base housing portion 102 by way of a hinging mechanism 106. While the cover portion 104 is hingedly connected to the base housing portion 102 in this aspect, it is to be appreciated that other aspects can employ a snap-fit, press-fit, screw-top, etc. cover portion (not shown) without departing from the spirit and/or scope of the innovation and claims appended hereto. Additionally, aspects can be configured without a cover portion 104. These alternatives are included within the scope of the features, functions and benefits described herein.

The message keeper 100 of FIG. 1 can stimulate a child's creativity and imagination by virtually collecting spoken (or whispered) messages. In operation, a child can speak a message (e.g., secret, wish, diary entry, idea) into message interface 108. The message interface 108 can be configured as an aperture in communication with a message acceptance chamber within base housing portion 102. Once a message is conveyed, the message keeper 100 can be employed to virtually store the spoken message.

Here, a chamber selector 110 can be employed to virtually transfer the message from a message acceptance chamber to a message storage chamber. As described herein, these chambers can be actual cavities within base housing portion 102 or, alternatively, can be established and conveyed merely by way of colors, textures, placement, indicia, or the like. By sliding the chamber selector 110 in a clockwise (or counter-clockwise) direction around track 112, a child can visualize the transfer (or virtual transfer in the case of spoken messages) of the message between the acceptance and storage chambers. In particular, a chamber viewer 114 can be employed to visualize motion of the chambers simultaneously with motion of the chamber selector 110. This motion will be better understood upon a review of the figures that follow.

Figure 2:
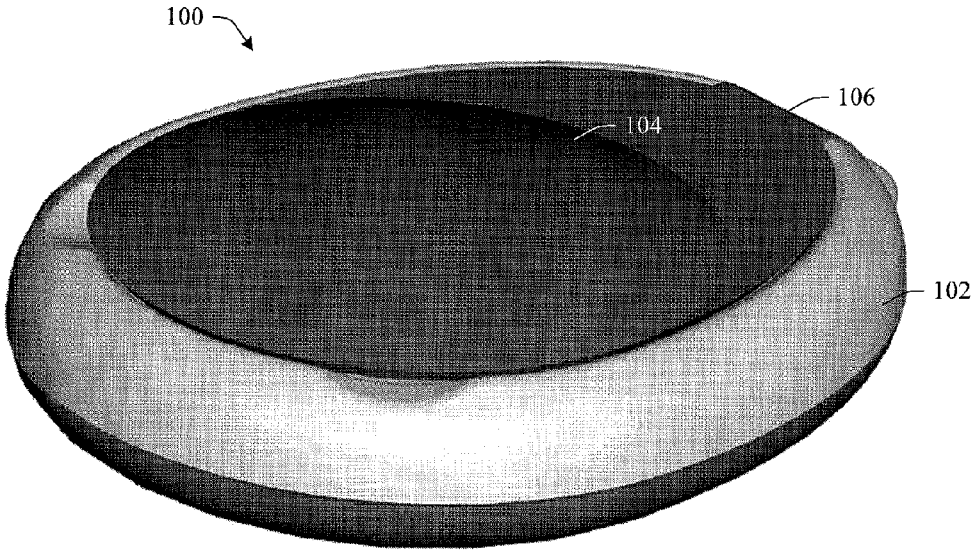
FIG. 2 illustrates a perspective view of an example closed message storage apparatus in accordance with aspects of the innovation.

Referring now to FIG. 2, an alternative perspective view of message keeper 100 is shown in accordance with an aspect of the innovation. In particular, the message keeper 100 is depicted in a closed position in FIG. 2. More particularly, cover portion 104 is shown in a hinged-closed position atop base housing portion 102. In this configuration, the cover portion 104 hides the message interface, chamber selector and chamber viewer (not shown). It will be appreciated that, in an alternative aspect, cover portion 104 can be translucent thereby exposing the interior of the message keeper 100.

Figure 3:
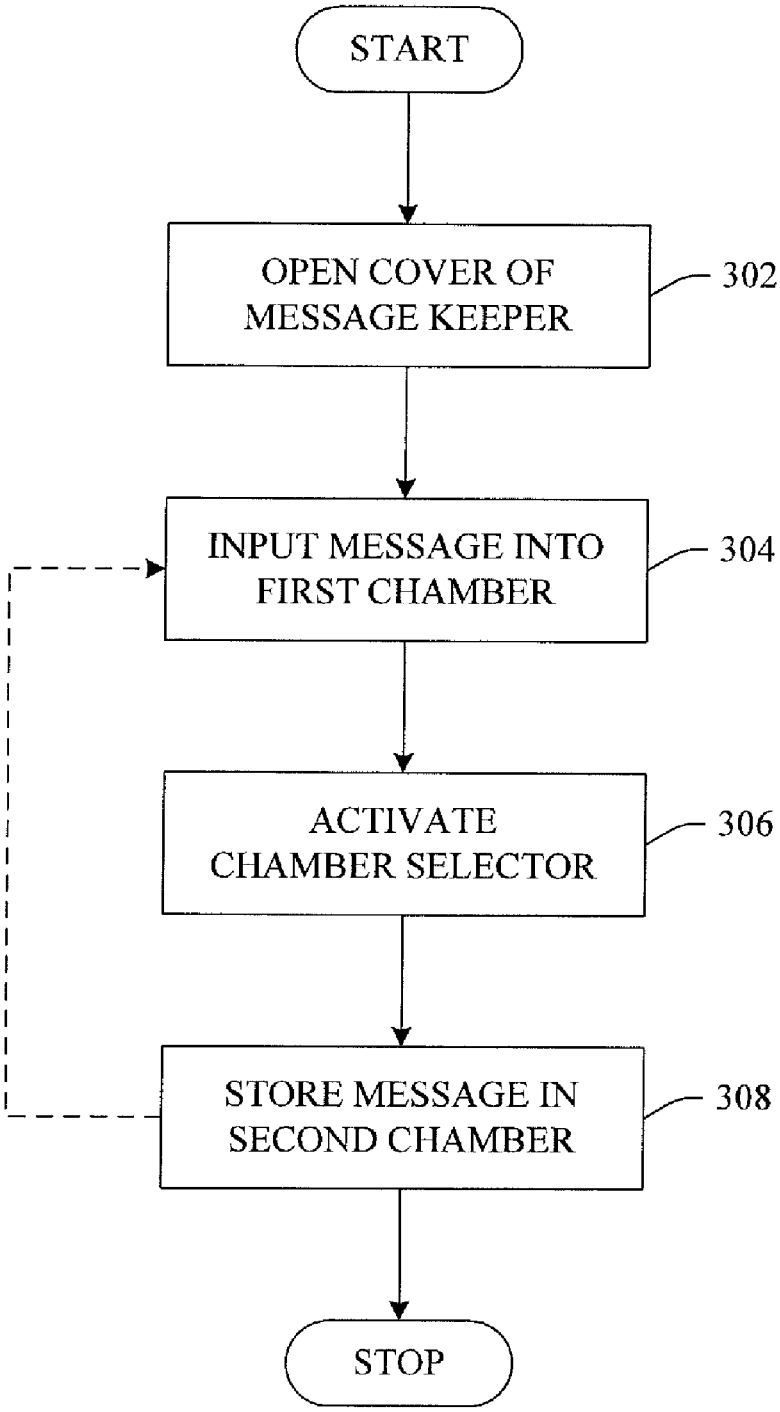
FIG. 3 illustrates an example flow chart of procedures that facilitate storage of messages in accordance with an aspect of the innovation.

FIG. 3 illustrates a methodology of inputting and storing messages in accordance with an aspect of the innovation. While, for purposes of simplicity of explanation, the one or more methodologies shown herein, e.g., in the form of a flow chart, are shown and described as a series of acts, it is to be understood and appreciated that the subject innovation is not limited by the order of acts, as some acts may, in accordance with the innovation, occur in a different order and/or concurrently with other acts from that shown and described herein. Moreover, not all illustrated acts may be required to implement a methodology in accordance with the innovation.

At 302, the cover of a message keeper can be opened to expose a message input interface. For instance, the cover can be hinged into an open position. As described above, it will be understood that the cover is optional—aspects can exist without the cover portion. As well, in other aspects, a cover can be pivoted, slid, removed, etc. without departing from the spirit and scope herein. At 304, a message can be input into the message interface. For instance, a secret message can be spoken, or whispered, into the interface. In other aspects, a physically documented message (e.g., written note) can be input into the interface. In either scenario, the message is transferred into a first, or message acceptance, chamber. As described above, this chamber can be a real or virtual cavity depending upon the design of the message keeper.

At 306, a chamber selector can be activated to facilitate movement (virtual or actual) of the message from the first chamber into storage, e.g., for safekeeping. The message is either virtually, or actually, moved from the first chamber to a second, or storage, chamber at 308. A dashed arrow is included on FIG. 3 to indicate that the process described herein is recursive and can be repeated for subsequent messages as desired.

Figure 4:
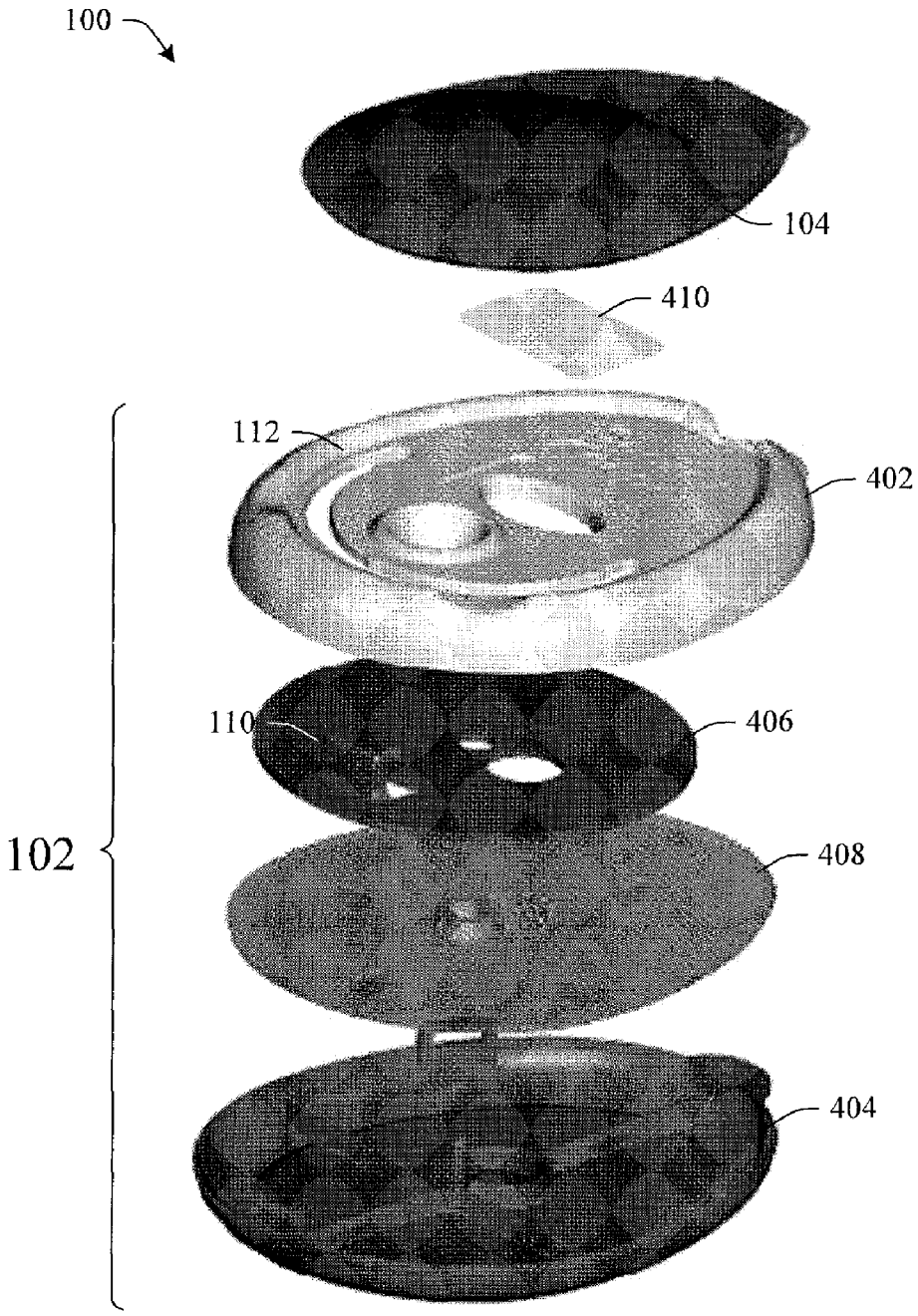
FIG. 4 illustrates an example exploded view of a message keeper in accordance with aspects of the innovation.

FIG. 4 illustrates an exploded view of an example message keeper 100. As illustrated, base housing portion 102 can include multiple subcomponents as shown. In particular, base housing portion 102 can include an upper housing portion 402 and a lower housing portion 404 that, when connected, form a cavity. Within the cavity, a chamber selector plate 406 and chamber identification plate 408 can be positioned.

The upper portion 402 of base housing portion 102 can include apertures or openings for message input, chamber selector slide as well as chamber visualization. A clear, translucent or semi-transparent window 410 can be placed onto the chamber view aperture as shown. It is to be appreciated that the components and subcomponents shown in FIG. 4 can be molded of plastic or other suitable material. As well, window 410 can be constructed of clear plastic or other translucent or semi-transparent material. In other aspects, the window portion 410 can be molded into the upper base portion 402 in a slotted or other manner that enables one to view the interworkings beneath the upper housing portion 402. This and other modifications to design are contemplated and to be included within the scope of this disclosure and claims appended hereto without departing from the features, functions and benefits described herein.

As illustrated described above, a chamber selector 110 can be moved (e.g., slid) along a track or guide 112 to facilitate movement (actual or virtual) of a message from one chamber to another. As shown, selector plate 406 can be molded with apertures such that, when positioned in a particular location, a first chamber can appear via the chamber viewing window 410. When the chamber selector is moved into a disparate position, an individual (e.g., a child) can view a chamber swap by way of the chamber viewer 410 as well as the message input interface. Additionally, as shown, the chamber selector 110 can be molded integral to the selector plate 406.

As described supra, it is to be appreciated that the first and second chambers can be actual or virtual cavities without departing from the spirit and scope of this specification and claims appended hereto. In other words, if a message is actually (or physically) inserted, e.g., tangible on paper, the chambers can be real cavities whereby the paper can transfer from a first chamber to the next. In a virtual aspect, the chambers can be imaginary and need not be physical chambers or cavities. In this aspect, colors, patterns, etc. viewed through the chamber viewer 410 can be employed to translate an appearance of the message moving from a first to a second chamber. Still further, it is to be understood that aspects exist that employ actual chambers which are able to be used with both tangible (e.g., paper) and intangible (e.g., spoken) messages.

Chamber plate 408 can be configured in a manner so as to convey an appearance of actual chamber swap, in both physical and virtual aspects. In aspects, the chamber plate 408 can be configured (or molded) with patterns, indicia, colors, etc. that convey a switch from one chamber to the next. For example, a first chamber can be shown to have a yellow background whereas, after the chamber selector is moved, the background can change to purple. This visual change can convey an appearance of moving the message from one chamber to the next, regardless of whether the movement is actual or virtual.

Figure 5:
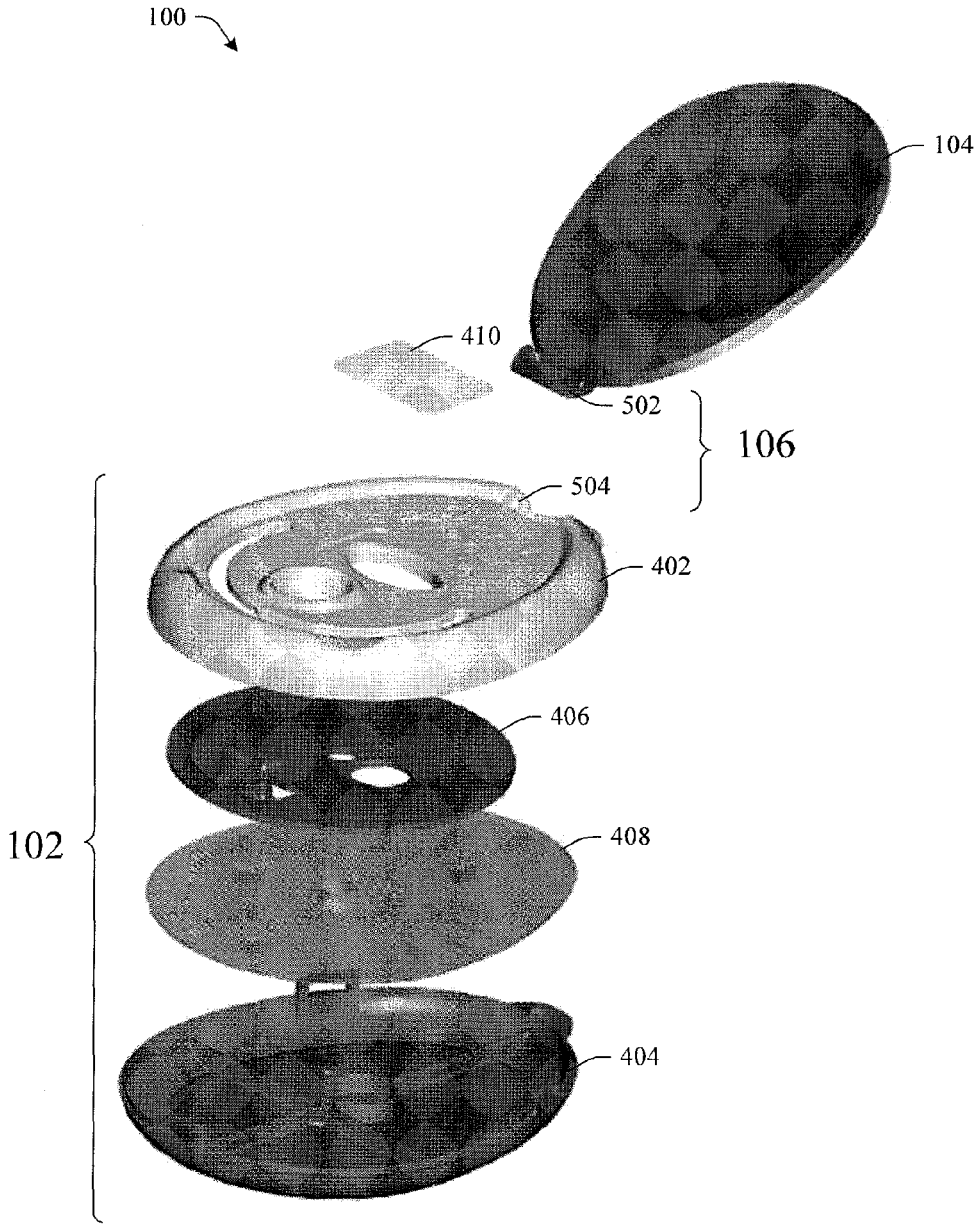
FIG. 5 illustrates an alternative example view of a message keeper in accordance with aspects of the innovation.

Referring now to FIG. 5, an alternative exploded view of example message keeper 100 is shown. In the alternative view, the lid portion 104 is illustrated in an open or "hinged-open" position. Hinging means 106, in this example, is configured using a molded portion of the lid portion 104 and upper base portion 402. These portions are illustrated at 502 and 504 respectively in FIG. 5. While a specific hinging means 106 is shown, those skilled in the art will appreciate that other aspects exist that employ different or no hinging means. These aspects are included within the scope herein.

Figure 6:
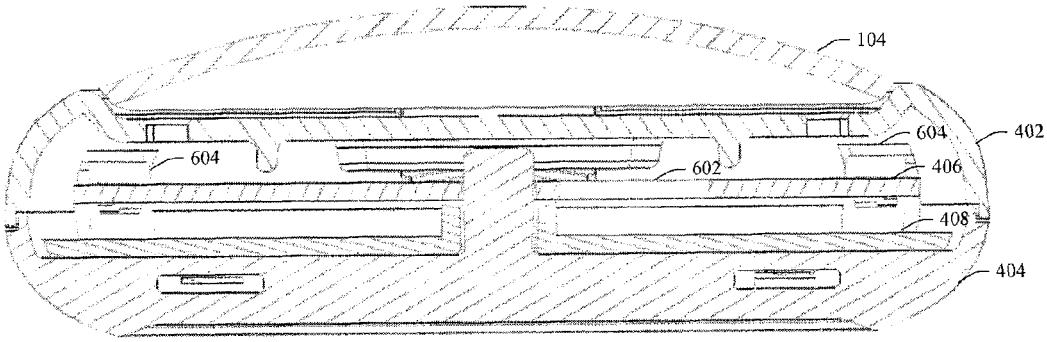
FIG. 6 illustrates a rear cross-sectional view of a message keeper in accordance with aspects of the innovation.
Figure 7:
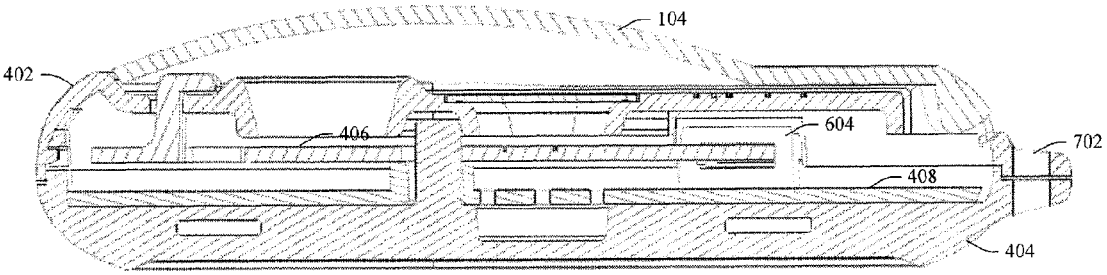
FIG. 7 illustrates a side cross-sectional view of a message keeper in accordance with aspects of the innovation.

FIGS. 6 and 7 are respectively rear and side cut-away views of example message keeper 100. Essentially, each of these figures illustrates interconnection and placement of the subcomponents to the base housing portion 102. The chamber viewing aperture is illustrated at 602 within selector plate 406. As described, the aperture 602 enables visualization of the chamber plate 408. The chamber plate 408 can include effects such as colors, textures, indicia, etc. that facilitate visualization of chamber changes.

Additionally, the upper 402 and lower 404 portions of base housing portion (102 of FIG. 1) can be connected using tabs 604. In this example, tabs 604 are molded into the lower portion 404. Upon assembly, the tabs 604 lock into raised portions of the inner side of upper portion 402 causing the two portions 402, 404 to fixedly connect.

FIG. 7 illustrates a side cross-sectional view of the example message keeper 100. As shown, the cross-sectional view illustrates interconnection and placement of each of the subcomponents. Further, it will be appreciated that this example resembles a locket such that a string, carry strap, necklace or the like can be inserted into aperture 702. This and other design aspects are contemplated and to be included within the scope of this innovation.

Additionally, message keeper 100 can include a key locking means (not shown) that prohibits the lid portion 104 from opening. Other aspects of locking means are contemplated, including, but not limited to, key locks, combination locks, digital locks that recognize handwriting, digital locks that recognize a code, digital locks that recognize voices, and others.

Figure 8:
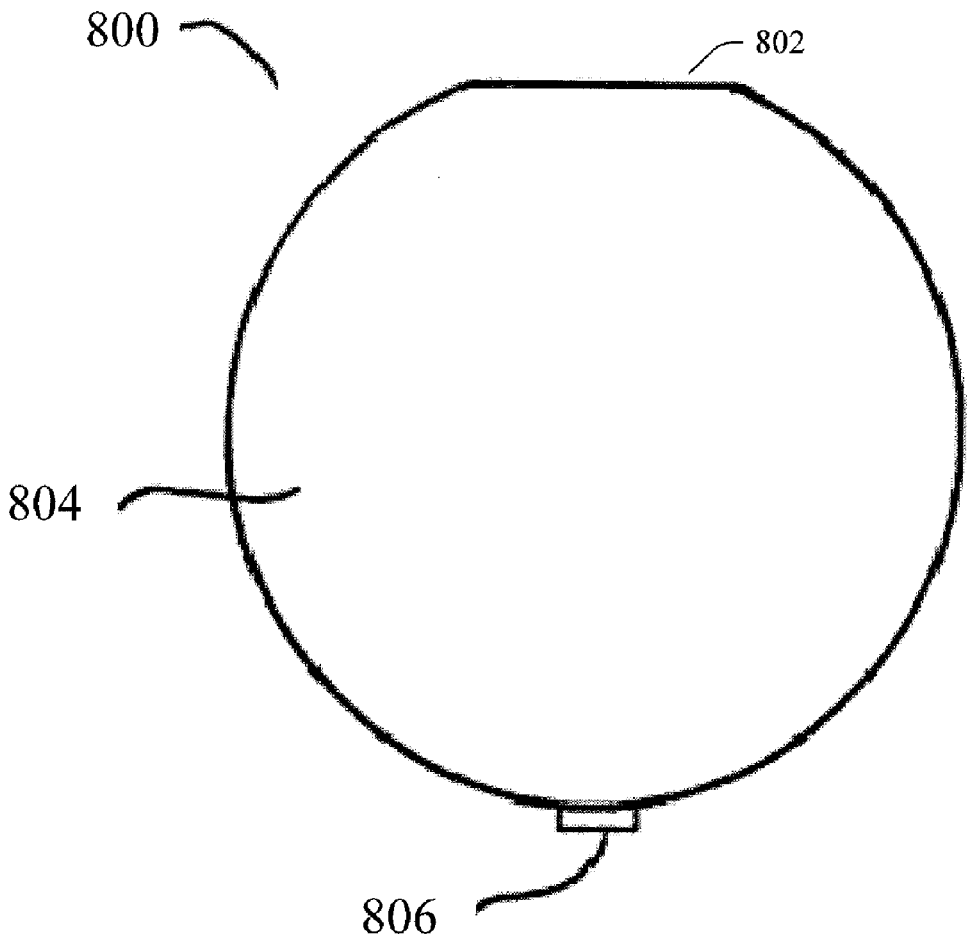
FIG. 8 illustrates a top perspective view of an example clamshell shaped message keeper in accordance with aspects of the innovation.

Referring to FIGS. 8 through 11, an example message keeper 800 in the shape of a makeup or cosmetic compact is shown. In this example, the components are fabricated (or molded) from plastic. FIG. 8 illustrates a top perspective view of message keeper 800. As with the aforementioned aspects, the components of this aspect may be transparent (or semi-transparent) such that the messages may be seen transferring between chambers, e.g., if they are physical messages.

With continued reference to FIG. 8, the message keeper 800 is configured in a clam shell-like arrangement similar to a makeup compact or a locket and represents potentially a pocked-sized version. The message keeper utilizes a hinge 802 which allows the device 800 to be opened. The hinge 802 pivots the cover 804 thereby exposing the interior of the device 800. A latching mechanism 806 can be employed to trigger opening of lid portion 804. In this aspect, latching mechanism 806 employs a push button. However, it is to be understood that most any mechanism (e.g., detent/snap) can be employed without departing from the spirit and/or scope of the innovation and claims appended hereto.

Figure 9:
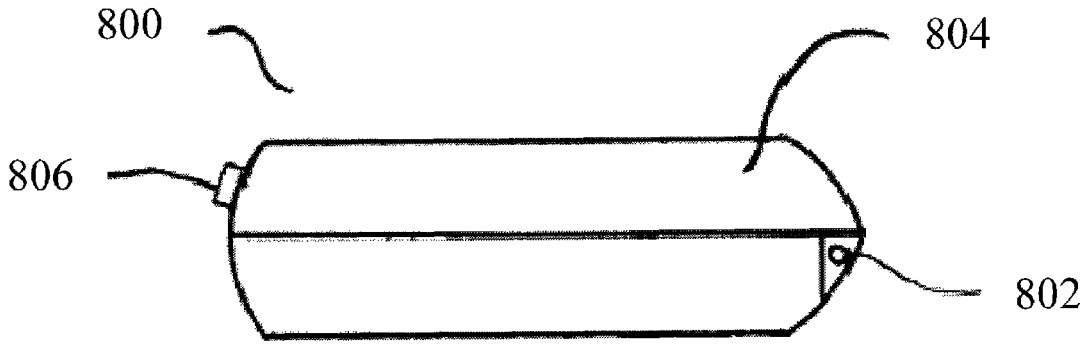
FIG. 9 illustrates a side perspective view of an example clamshell shaped message keeper in accordance with aspects of the innovation.

A side perspective view of device 800 is illustrated in FIG. 9. As described with reference to the previous aspect, device 800 can be equipped with a locking means that prohibits opening of the lid portion 804. In yet other aspects, a locking mechanism (not shown) can secure access to the interior components housed below the lid 804. These locking mechanisms will be better understood upon a review of the figures that follow.

Figure 10:
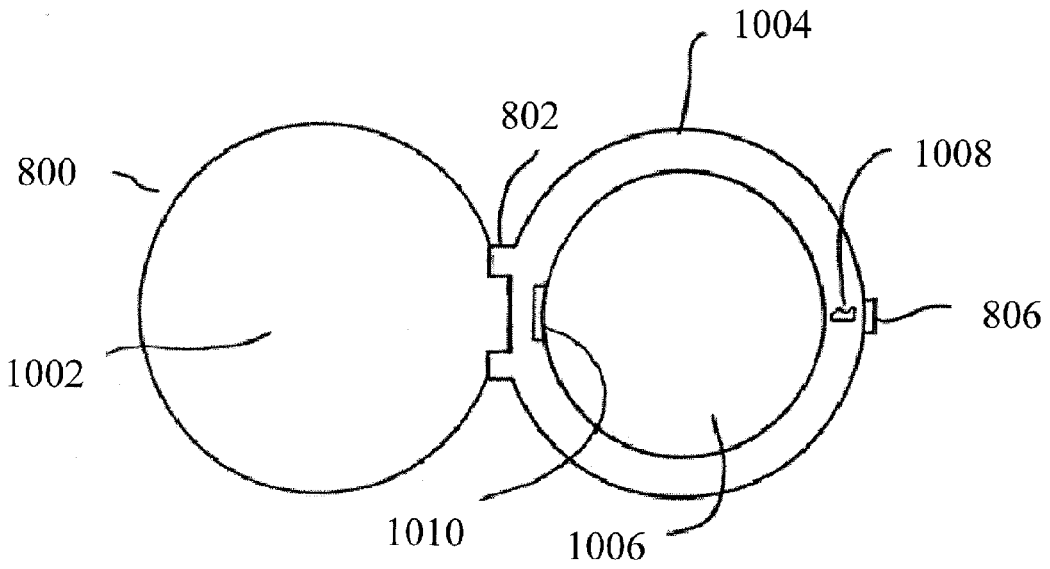
FIG. 10 illustrates a top perspective view of an example hinged-open clamshell shaped message keeper in accordance with aspects of the innovation.
Figure 11:
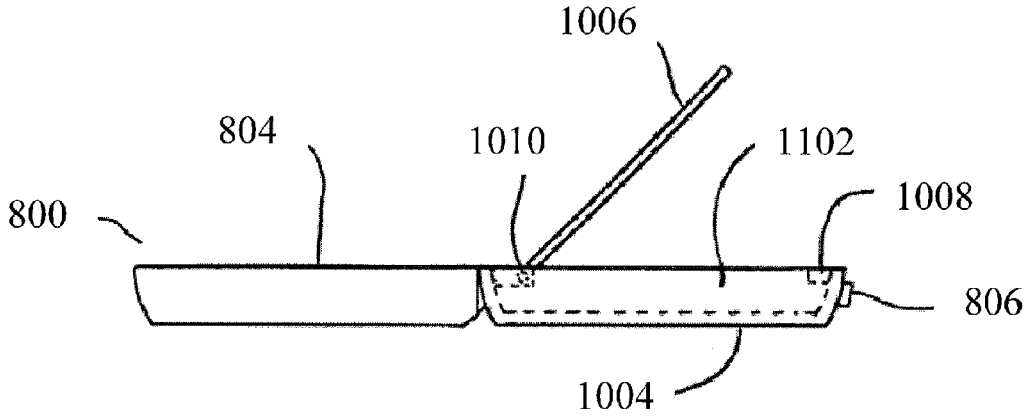
FIG. 11 illustrates a side perspective view of an example hinged-open clamshell shaped message keeper in accordance with aspects of the innovation.

In the open state depicted in FIGS. 10 and 11, there is a first side 1002 (e.g., lid 804) and a second side 1004 pivotably connected by way of hinging means 802. The first side 1002 may be used for makeup and include a reflective surface (e.g., mirror as in a makeup compact), to store a picture (e.g., as in a locket) or for other purposes. The second side 1004 is the message storing portion where the message storage chamber (s) is enclosed with a lid 1006. The lid 1006 pivots on hinging means 1010 and can be locked with a locking mechanism 1008. Though the locking mechanism 1008 is shown as a means that most likely uses a key, other locking means are contemplated such as combination locks or the like. In this aspect, messages may be retrieved from a single chamber message keeper by opening the lid 1006 to provide access to the message storage chamber. Similarly, in a multiple chamber aspect, a similar mechanism can be employed to access stored messages.

FIG. 11 illustrates a side view of device 800 in an open position. As will be understood, the device 800 is most often used in connection with tangible or physical messages that can be placed within cavity 1102 for safekeeping. The locking means 1008 can provide security to a child (or other user) by knowing that their messages are safe from public view.

This message keeper 800 may utilize most any message input system, for example, though a simple sliding mechanism that exposes an aperture for message entry. The user may deposit physical or spoken messages through an opening created by a sliding mechanism in an open state. Unlike the earlier aspect that employed two chambers, in this aspect, messages can reside in a single storage chamber 1102. The chamber can be locked by a locking means 1008 and pivoted open by way of hinging means 1010.

In addition to the examples shown and described, other pocket type configurations similar to the embodiments are also possible such as a sliding arrangement instead of a pivoting arrangement. Aspects may include a detent or snap-to-close feature and retention devices such as key chains, necklaces, clips, lanyards, and the like. It is to be understood that most any of the message keeper embodiments may be configured as single- or multi- (e.g., double) chamber devices.

Figure 12:
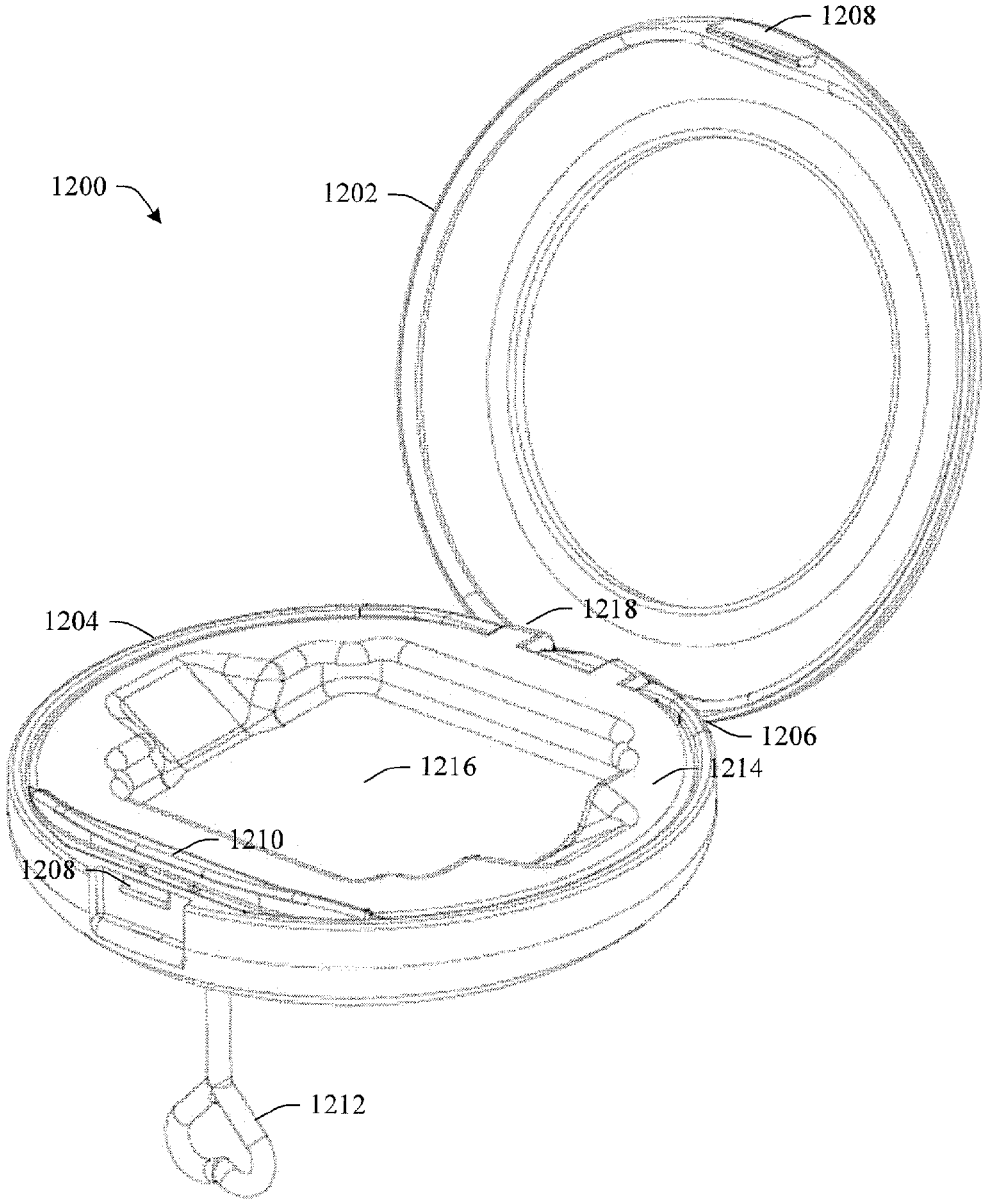
FIG. 12 illustrates a perspective view of an example clamshell shaped message keeper in accordance with aspects of the innovation.

FIGS. 12 to 16 illustrate another example of a clamshell shaped embodiment of a message keeper 1200 in accordance with the innovation. As shown in FIG. 12, the apparatus 1200 includes a cover portion 1202 and a base portion 1204. The cover portion 1202 can be hingedly connected to the base portion 1204 by way of a hinging means 1206. In other aspects, the cover portion 1202 can be press-fit, snap-on, screwed on, or the like. As shown, the cover portion can include a latching means 1208 (e.g., detent/snap).

In one particular aspect, once closed, a locking means 1210 can be employed to secure the apparatus in a closed position. The aspect of FIG. 12 can optionally employ a locking means 1210 and a key 1212 to secure the apparatus in a closed position. Other aspects can employ combination-type locks or the like.

With continued reference to FIG. 12, a cavity cover 1214 can include impression 1216 that is configured or adapted for storing a pad of paper (e.g., 3M-brand Post-It™ products or the like). The cavity cover 1214 can be hingedly connected to the base portion 1204 by way of a hinging means 1218 (or other suitable connection).

Figure 13:
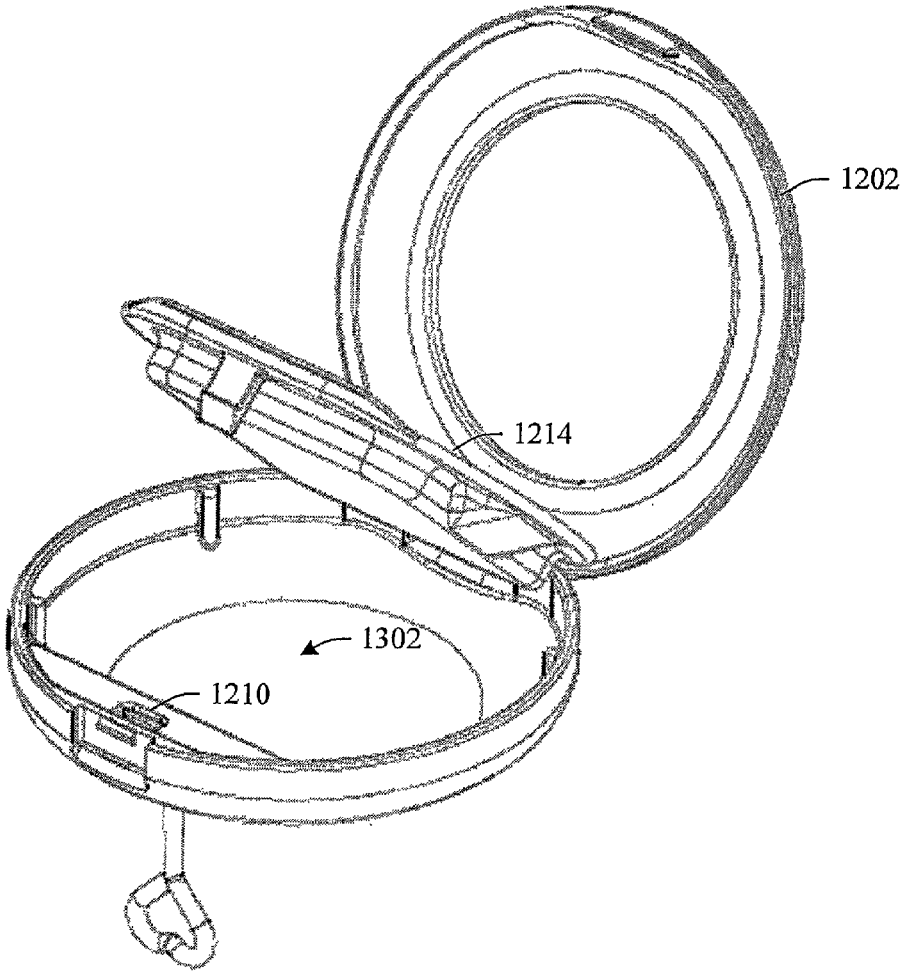
FIG. 13 illustrates an alternative perspective view of an example clamshell shaped message keeper in accordance with aspects of the innovation.

Referring now to FIG. 13, here, the cavity cover 1214 is illustrated in an open position thereby exposing the cavity 1302. In operation, a message can be written onto a piece of paper and subsequently stored within cavity 1302. It will be appreciated that, the locking mechanism 1210 can be used to securely store the message within cavity 1302 by locking the cavity cover 1214 in a closed position atop the base portion 1204.

Figure 14:
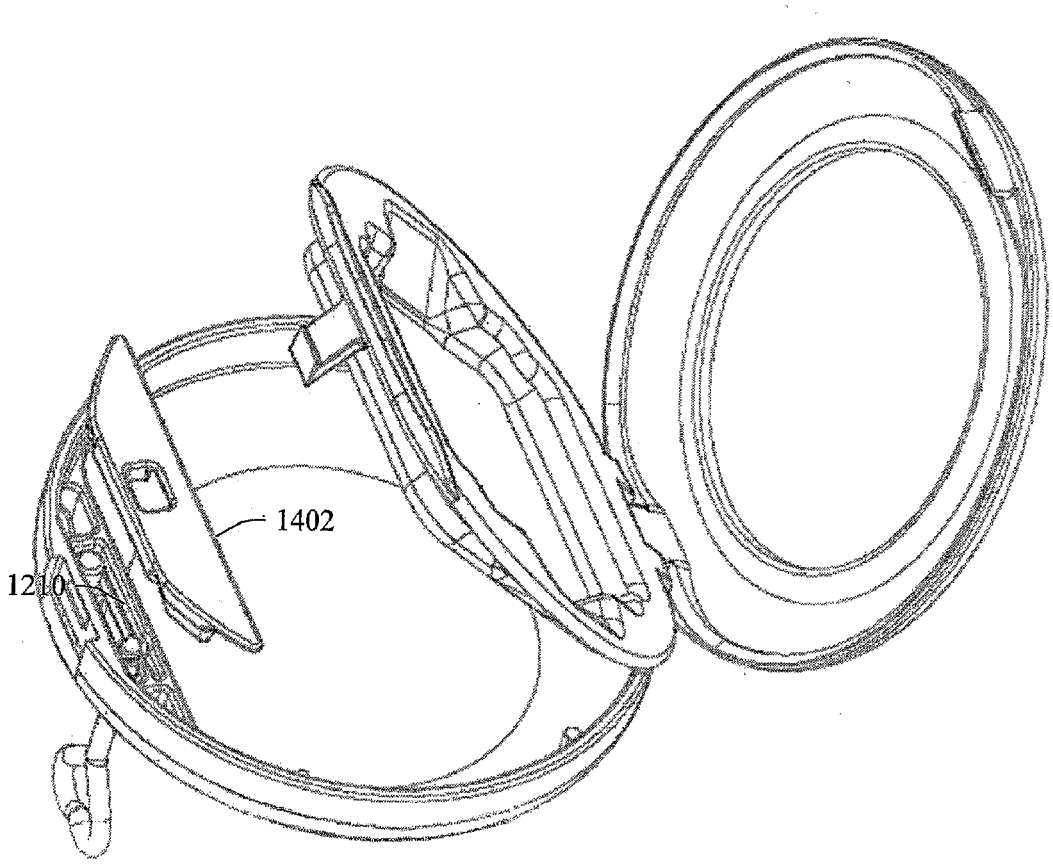
FIG. 14 illustrates a view of an locking mechanism cap in accordance with aspects of the innovation.
Figure 15:
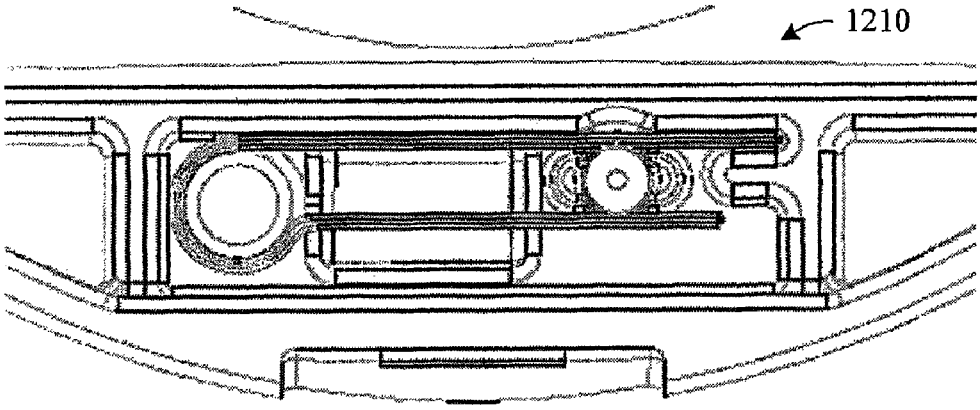
FIG. 15 illustrates a view of an example locking mechanism in accordance with aspects of the innovation.

FIGS. 14 and 15 illustrate an example locking means or mechanism 1210 in accordance with aspects of the innovation. As shown in FIG. 14, the locking mechanism can include a cap portion 1402 that encloses the locking mechanism 1210. An example locking mechanism is illustrated in FIG. 15 to add perspective to the innovation. As will be understood, rotation of a key will open the locking means thereby enabling the message keeper to open. It will be understood that most any locking mechanism can be employed in alternative aspects without departing from the spirit and/or scope of the innovation and claims appended hereto.

Figure 16:
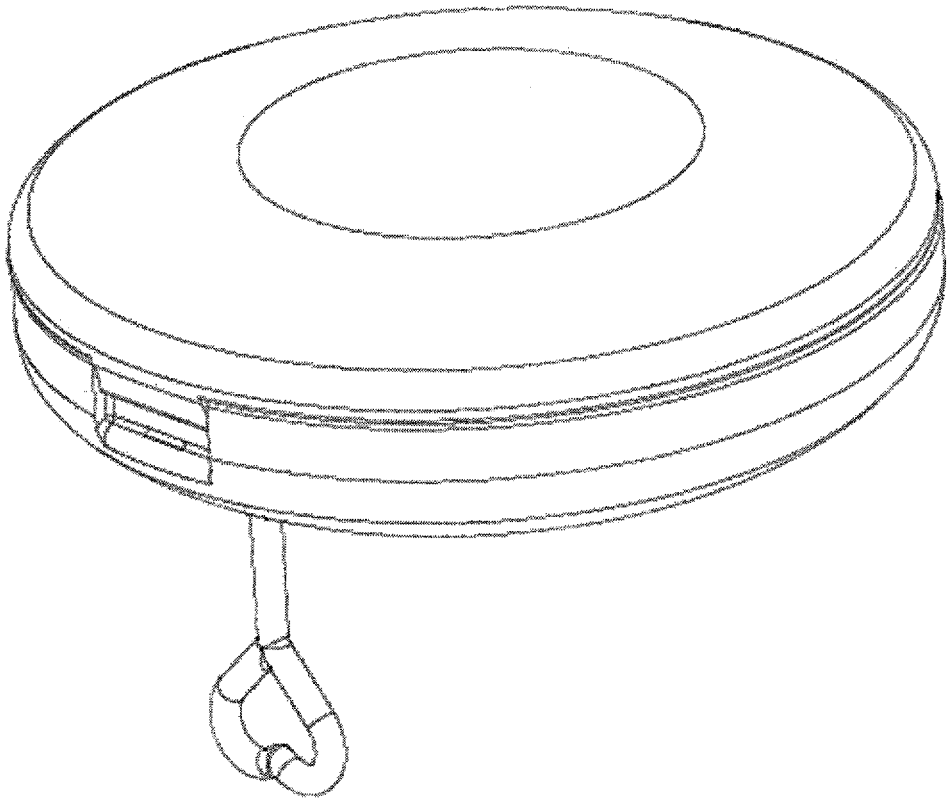
FIG. 16 illustrates a perspective view of an example clamshell message keeper in a closed and locked state.
Figure 17:
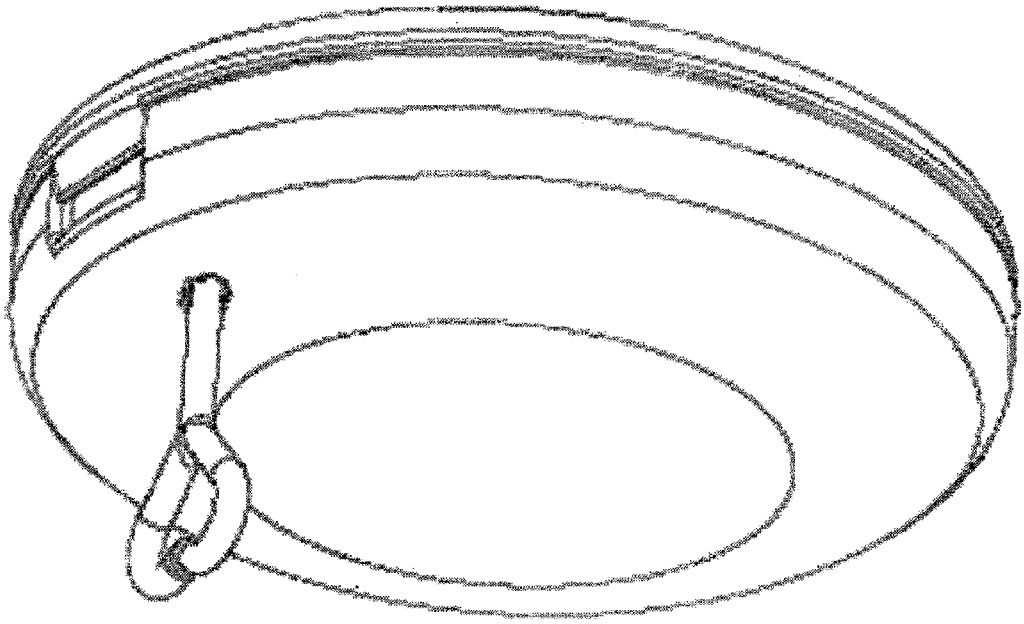
FIG. 17 illustrates a bottom perspective view of an example clamshell message keeper in a closed and locked state.

FIGS. 16 and 17 are illustrative of the example clamshell message keeper in a closed and locked state. As described herein, it will be appreciated that the message keeper can be configured in most any shape without departing from the features, functions and benefits set forth herein.

The message keeper is a device that can be used to stimulate the creativity and imagination of young children. Accordingly, the innovation will most likely be used in a manner for amusement and entertainment purposes. However, due to its nature as a verbal device, it may be used as an educational tool to promote literacy as an edutainment device to a wide age range.

In place of, or in addition to, storage chamber(s), it is to be appreciated that message keepers described herein can be equipped with electronics means capable of capturing audible messages. The following paragraphs describe how these aspects of a message keeper can be used as an educational device and how it can integrate to a software tool, for example, an Internet (Web) software tool, software-based educational tool or the like. Unlike other educational devices and toys that have a significant learning element to them, the message keeper is a device that can integrate directly with the daily lives of children. This means that it is a device that is likely to be with the user throughout the day and is not a game that either one is forced to use for learning or one that the user easily tires of. To make the message keeper a device that is prolifically used, the learning element can be partially separated from amusement elements.

Thus, children are able to use the innovation, have fun with the device, and then re-live the enjoyable moments while they transfer their day's activity to a software tool, e.g., standalone software or Web-based (or other computer-based environment) learning tool. It is contemplated that this learning tool can complement the product and provide targeted marketing opportunities.

In these examples, an online or computer-based tool can be provided that allows users to upload messages for secured storage. The tool can also facilitate generation of diary or journal entries and to be able to link these entries to the dreams, secrets, etc. Still further, the tool can allow for social networking with other users (e.g., Web users), for example, via an invited friend network. Other uses of the tool can include providing story starter aides that are both general and targeted to key words from the user's inputs, delivery of vocabulary words and grammar tips each day, correction of grammar and spelling of the inputs in an enjoyable manner, providing parental controls and parental monitoring of learning trends and needs for further educational supplement; and providing a mechanism for targeted advertising through a wide range of ages.

As will be understood, the message keeper can be packaged into a product that is fun to use and can stand alone on this merit. The features, functions and benefits of the innovation can also be integrated with significant educational elements that promote literacy through enjoyable and contributory learning.

As described herein, the message keeper device can be designed in a multitude of different versions, types, and aesthetic configurations. However, they all are similar in that they are designed to be message storage devices. As described, aspects differ in the way that messages are input and stored within the device, whether physical or spoken messages. Messages may be whispered into the device, written on a note card, or recorded with an audio recording device.

In electronic aspects, with regard to whispered messages (typical for younger users), the person using the device will benefit by remembering the message for later interface to a Web or software tool. For written messages, they may be extracted from the message keeper and, if desired, transcribed into a Web tool. Recorded and other electronically captured messages may be uploaded automatically by using a computer docking tool which may interface (e.g., via Universal Serial Bus (USB) or wirelessly) to a computer.

As stated above, the drawings and this detailed description are provided not to limit the scope of the innovation and device but rather to depict several embodiments that illustrate features, functions and benefits of the innovation. Many of the aspects of each embodiment are applicable to many of the other embodiments but are, for simplicity, described only for some of the embodiments.

Some of these flexible and interchangeable attributes are: sizes and shapes, materials, colors, opacity, types and placement of openings, types and placement of closures, types and placement of locking mechanisms, types and placement of hinging means, position of storage chamber(s) relative to the receiving chamber(s), types of messages that the device can store, means to remove the messages, ancillary devices, electronics, etc.

Accordingly, embodiments may have different sizes and shapes including, but not limited to, the following shapes: conical, frusto-conical, cylindrical, spherical, those with a polygonal cross-section, clamshell, shapes with amorphous cross-sections, free form three dimensional shapes, round, square, rectangular, and others. Additionally, embodiments are contemplated to be vertical devices. That is that the message is deposited in a top down manner and is in turn routed to another vertically oriented opening to be received by a storage chamber that is generally vertically underneath the first chamber and delivery mechanism. Other configurations are possible such as side-by-side, diagonally oriented chambers, and routings that also take on free form shapes as well as multiple storage chambers into which messages can be stored.

In accordance with aspects of the innovation, the message keepers can be constructed in a manner that includes two primary components/sub-assemblies: the storage chamber, and the delivery mechanism. Essentially, the delivery mechanism can be used to describe the input together with the chamber selector.

The embodiments of the innovation can be fitted with additional openings with closures of various types to the storage chamber. This will allow the easy removal of a message. Preferably, these closures would be threaded but all types of closures are possible (e.g., press-fit, snap-fit). As well, the closures can be equipped with locking means as desired.

Each of the described embodiments may be fabricated from materials of different colors, transparency, and, opacity. These materials include, but are not limited to, plastic fiberboard, composite materials, various ferrous and non-ferrous metals, wood, aluminum, alloys, and others. In other words, most any suitable material can be employed. Additionally, it is to be appreciated that aspects can include non-rigid configurations without departing from the scope of this specification. For example, where appropriate, non-rigid materials can be employed together with rigid materials in some aspects.

Each of the described embodiments may have different types and sizes of openings and closures. The openings through which a message is deposited may be of a variety of sizes and shapes including, but not limited to, round, oval, elliptical, polygonal, free form, and others. Typically, there is both a first and second opening per message keeper; one for depositing the message and one through which the message passes (or virtually passes) from the first chamber to the second or storage chamber. The relative position of the first and second opening to one another is not fixed and may be coincident or non-coincident and may even be non-parallel. The innovation contemplates many types of closures, most of which are interchangeable from embodiment to embodiment, and some of which ensure that one opening is closed at all times.

Some of the embodiments are described to be used in conjunction with tools and other devices. Other devices and toys that message keepers integrate with include, but are not limited to, voice/sound recorders, USB and other computer interface devices, wireless communication protocols, text entry devices, digital cameras, diaries and scrapbooks, dolls and other toys and figurines, and music players such as MP3 devices, and others.

What has been described above includes examples of the innovation. It is, of course, not possible to describe every conceivable combination of components or methodologies for purposes of describing the subject innovation, but one of ordinary skill in the art may recognize that many further combinations and permutations of the innovation are possible. Accordingly, the innovation is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. An apparatus that facilitates storage of messages, comprising:

a message interface that receives a one or more messages into a first chamber;

a chamber selector that moves within a track that facilitates an actual or a perceived transference of the one or more of the messages from the first chamber to a second chamber;

a chamber identification plate having disparate effects applied thereto that designate the first chamber and the second chamber; and a base housing portion that stores the one or more of the messages in the second chamber, wherein the actual or perceived transference of the one or more messages from the first chamber to the second chamber includes rotation of a chamber selector plate via the chamber selector thereby changing an appearance of the disparate effect on a chamber identification plate to a user via a transparent visualization window.

2. The apparatus of claim 1, wherein the base housing portion comprises an upper housing portion and a lower housing, wherein the upper housing portion fixedly attaches to the lower housing portion forming a cavity therein, the first and second chambers are designated within the cavity.

3. The apparatus of claim 2, wherein the upper housing portion comprises a chamber view aperture that facilitates visualization of the one or more messages moving from the first chamber to the second chamber.

4. The apparatus of claim 3, wherein the transparent visualization window is fixedly attached atop the chamber view aperture.

5. The apparatus of claim 2, wherein the chamber selector plate includes at least one aperture therein, and wherein the chamber selector plate rotates simultaneously with the chamber selector and reveals the first and second chamber to a user.

6. The apparatus of claim 1, wherein the disparate effects are at least one of color, texture or indicia.

7. The apparatus of claim 2, further comprising a cover portion that is hingedly connected to the base housing portion, wherein the cover portion, when closed, conceals the message input interface.

8. The apparatus of claim 2, wherein the cover portion comprises a locking means that secures the cover portion into the upper housing portion.

9. The apparatus of claim 2, wherein the upper base portion, the lower base portion and the cover portion are injection molded plastic components.

10. The apparatus of claim 1, wherein the one or more messages is written for use in one of amusement, journal writing, scrapbook activities, note taking, diary writing, literacy, training, or sharing with others.

11. The apparatus of claim 1, further comprising an electronic means that interfaces with an educational tool, wherein the educational tool accesses and employs the one or more of the messages.

12. A method for storing information, comprising:

inputting a message into a message interface, wherein the message enters a message acceptance chamber;

activating a chamber selector;

viewing one of an actual or perceived motion of the message from the message acceptance chamber to a message storage chamber; and storing the message in the message storage chamber, wherein the actual or perceived motion of the message from the message acceptance chamber to the message storage chamber is represented by rotation of a chamber selector plate thereby changing an appearance of disparate effects on a chamber identification plate to a user via a transparent visualization window.

13. The method of claim 12, further comprising hinging a cover portion that exposes the message interface.

14. The method of claim 12, the act of activating the chamber selector included sliding the chamber selector within a track that simultaneously rotates the chamber selector plate.

* * * * *

UNITED STATES PATENT AND TRADEMARK OFFICE

CERTIFICATE OF CORRECTION

PATENT NO. : 8,380,120 B1
APPLICATION NO. : 12/706280
DATED : February 19, 2013
INVENTOR(S) : Maegan Ruhlman et al.

It is certified that error appears in the above-identified patent and that said Letters Patent is hereby corrected as shown below:

Title Page, Item (75) Inventors:

The spelling of the first inventor's name should be changed from "Meagan" Ruhlman to --Maegan-- Ruhlman.

Signed and Sealed this
Thirtieth Day of April, 2013

Teresa Stanek Rea
*Acting Director of the United States Patent and Trademark Office*